US010836615B2

(12) United States Patent
Lissandre et al.

(10) Patent No.: US 10,836,615 B2
(45) Date of Patent: Nov. 17, 2020

(54) LUFFING JIB CRANE WITH A DEVICE FOR LOCKING THE JIB IN A RAISED CONFIGURATION

(71) Applicant: Manitowoc Crane Group France, Dardilly (FR)

(72) Inventors: Michel Lissandre, Sain Bel (FR); Sylvain Raymond, Champfromier (FR); Michael Mollenthiel, Villeurbanne (FR); Florent Mourin, Chasselay (FR); Alexis Thery, Saint Etienne (FR)

(73) Assignee: Manitowoc Crane Group France, Dardilly (FR)

( * ) Notice: Subject to any disclaimer, the term of this patent is extended or adjusted under 35 U.S.C. 154(b) by 234 days.

(21) Appl. No.: 16/155,545

(22) Filed: Oct. 9, 2018

(65) Prior Publication Data

US 2019/0106304 A1 Apr. 11, 2019

(30) Foreign Application Priority Data

Oct. 9, 2017 (FR) ..... 17 59434

(51) Int. Cl.
*B66C 23/82* (2006.01)
*B66C 23/16* (2006.01)
(Continued)

(52) U.S. Cl.
CPC ..... *B66C 23/828* (2013.01); *B66C 15/06* (2013.01); *B66C 23/16* (2013.01); *B66C 23/26* (2013.01);
(Continued)

(58) Field of Classification Search
CPC ..... B66C 23/16; B66C 23/26; B66C 23/62; B66C 23/82; B66C 23/828; B66C 23/90;
(Continued)

(56) References Cited

U.S. PATENT DOCUMENTS 2,393,312 A * 1/1946 Davenport ..... B66C 23/92 212/280
3,982,648 A * 9/1976 Luedtke ..... E02F 3/388 414/713
(Continued)

FOREIGN PATENT DOCUMENTS

CN 203474324 U 3/2014
DE 102015119381 B3 4/2017
(Continued)

OTHER PUBLICATIONS

French Search Report issued by INPI in connection with FR1759434 dated Jun. 1, 2018.

*Primary Examiner* — Michael R Mansen
*Assistant Examiner* — Juan J Campos, Jr.
(74) *Attorney, Agent, or Firm* — Levenfeld Pearlstein, LLC

(57) ABSTRACT

A crane having a luffing jib and a lifting cylinder includes a cylinder body and a movable rod hinged on the jib to raise and lower the jib, and a locking device adapted to cooperate with the lifting cylinder to mechanically lock the rod in a deployed holding position and block the jib in a raised holding configuration, and further including a spacer hinged on the jib and supporting an abutment, the spacer configured for pivoting between a release position wherein the spacer is offset, authorizing the movable rod to be displaced freely, and a locking position wherein the spacer is folded so that the abutment is able to bear on the cylinder body to fixedly maintain the movable rod in the deployed holding position.

20 Claims, 6 Drawing Sheets

(51) Int. Cl.

| | |
|---|---|
| ***B66C 23/26*** | (2006.01) |
| ***B66C 23/90*** | (2006.01) |
| ***B66C 23/92*** | (2006.01) |
| ***B66C 23/62*** | (2006.01) |
| ***F15B 15/26*** | (2006.01) |
| ***B66C 15/06*** | (2006.01) |

(52) U.S. Cl.
CPC ..... *B66C 23/62* (2013.01); *B66C 23/82* (2013.01); *B66C 23/90* (2013.01); *B66C 23/92* (2013.01); *F15B 15/26* (2013.01); *B66C 2700/0392* (2013.01)

(58) Field of Classification Search
CPC ..... B66C 23/92; F15B 15/26; F15B 15/261; F15B 15/267
USPC ..... 212/292
See application file for complete search history.

(56) References Cited

U.S. PATENT DOCUMENTS 4,039,093 A * 8/1977 Schmitz, Jr. ..... B66C 23/88 414/680
4,043,253 A * 8/1977 Albright ..... E02F 3/388 92/25
4,073,345 A * 2/1978 Miller ..... A01B 63/22 172/413
5,009,566 A * 4/1991 Asche ..... E02F 3/388 414/685
5,163,803 A * 11/1992 Marola ..... B60P 3/125 280/402
5,634,762 A * 6/1997 Kim ..... E02F 9/24 414/685
6,149,374 A * 11/2000 Dershem ..... E02F 3/3414 212/292
6,171,050 B1 * 1/2001 Johnson ..... E02F 3/34 414/685
7,160,076 B2 * 1/2007 Curl ..... E02F 3/388 172/481
7,614,842 B2 * 11/2009 Ellefson ..... E02F 3/283 298/17 R
8,726,622 B2 * 5/2014 Wagner ..... A01D 41/145 56/15.9
9,567,855 B1 * 2/2017 Kundel ..... F01B 25/00
2012/0152109 A1 * 6/2012 Wagner ..... A01D 75/20 92/14
2014/0157746 A1 * 6/2014 Dilts ..... A01D 41/145 56/208

FOREIGN PATENT DOCUMENTS

WO 2016201270 A1 12/2016
WO 2017109309 A1 6/2017

* cited by examiner

LUFFING JIB CRANE WITH A DEVICE FOR LOCKING THE JIB IN A RAISED CONFIGURATION

CROSS-REFERENCE TO RELATED APPLICATION

This application claims priority under 35 U.S.C. § 119(a) to French Patent Application No. 17/59434, filed on Oct. 9, 2017, the disclosure of which is incorporated by reference herein in its entirety.

FIELD

The present invention relates to a luffing jib crane, for example, a luffing jib tower crane. The present invention may apply to several crane structures, for example to structures composed of lattices and chords.

BACKGROUND

It is known, in particular from the document WO 2017/109309, a luffing jib crane provided with a lifting cylinder, this lifting cylinder comprising a cylinder body mechanically connected to a structural element of the crane and a movable rod hinged on the luffing jib, wherein the movable rod is displaceable in the cylinder body between at least one deployed position and at least one retracted position to raise and lower the luffing jib between at least one raised configuration and at least one lowered configuration.

In case of strong winds, for example, it is recommended, or even required by some local standards or regulations, to carry out a weathervaning of the jib, by disengaging the jib (in other words by unblocking the orientation brakes) so that it is free in rotation to be automatically oriented in the direction of the wind and thus allow leaving the crane without human supervision. In the case of a luffing jib crane, the weathervaning is carried out with the jib in a raised configuration corresponding to a configuration accurate enough to minimize the radius of gyration of the jib and thus prevent the jib, in weathervane, from moving over areas in the proximity of the worksite, such as traffic lanes, buildings, etc.

Moreover, it can be provided that the jib is maintained in a raised configuration even during operation, when the crane handles a load, in order to prevent the jib and the suspended load from moving over such areas in the proximity of the worksite.

Thus, it is desirable to maintain the jib in the raised configuration, so as to substantially avoid movement over the prohibited areas, even during very large periods that may extend to several months without supervision.

When the jib is weathervaned, the wind pushes on the jib from the rear, generating forces on the lifting cylinder, and it is therefore desirable that the lifting cylinder does not deform, and particularly does not compress, at the risk that the jib lowers and therefore moves over the prohibited areas.

Moreover, the raising or lowering movement of the jib is performed by the lifting cylinder, which can be a hydraulic or electric cylinder. This lifting cylinder is always connected between the structural element and the jib, which has the consequence of controlling the movement of the jib in the upward direction (when raised) and also in the downward direction (when lowered).

However, in the particular case of a crane with a hydraulic lifting cylinder, when the jib is to be maintained in the raised configuration, the jib is held in both directions due to the lifting cylinder, but hydraulic fluid leaks and/or hydraulic fluid expansion phenomena may cause a compression of the lifting cylinder (in other words a retraction of the movable rod), which may lead to an uncontrolled and undesired lowering of the jib, which may be detrimental if the jib is weathervaned; such hydraulic fluid leaks can be internal to the lifting cylinder as well as external at the seals or hoses of the hydraulic system.

SUMMARY

An aim of the present invention is to overcome all or part of the aforementioned drawbacks, by proposing a locking device to block the luffing jib in a raised holding configuration, regardless of the external conditions, even during long periods in which the jib is weathervaned in the raised holding configuration without human control.

Thus, the invention aims at ensuring a fixed reach of the jib to meet the prohibitions of moving over areas in the proximity of the worksite, even under high wind conditions.

To this end, a crane comprising a luffing jib and a lifting cylinder is proposed, this lifting cylinder comprising a cylinder body mechanically connected to a structural element of the crane and a movable rod hinged to the luffing jib, wherein the movable rod is displaceable in the cylinder body between at least one deployed position and at least one retracted position in order to raise and lower the luffing jib between at least one raised configuration and at least one lowered configuration, this crane further comprising a locking device adapted to cooperate with the lifting cylinder in order to mechanically lock the movable rod in a deployed holding position and thus block the luffing jib in a raised holding configuration, wherein this locking device comprises a spacer provided with a proximal portion hinged on the jib and with a distal portion supporting an abutment, wherein this spacer is pivotally movable on the jib between:

- a release position wherein the spacer is offset vis-a-vis the lifting cylinder such that its distal portion is spaced apart from the lifting cylinder, authorizing the movable rod to be displaced in the cylinder body and to act on the displacement of the luffing jib; and
- a locking position wherein the spacer is folded over the lifting cylinder such that the abutment is able to bear on the cylinder body.

With the invention, a locking of the luffing jib in the raised holding configuration is carried out according to the following locking sequence:

- in a first phase or operating phase, the spacer is in the release position and the movable rod is free to be displaced in the cylinder body to act on the displacement of the luffing jib;
- in a second phase or transitional phase, the movable rod is deployed to a deployed transition position, beyond the deployed holding position, and the spacer is displaced to its locking position by being folded over the movable rod;
- in a third phase or locking phase, the movable rod is retracted from the deployed transition position towards the deployed holding position until the abutment bears on the cylinder body so that the spacer fixedly maintains the movable rod in the deployed holding position in order to lock the luffing jib in the raised holding configuration.

Thus, this locking device with a pivoting spacer allows to block accurately the jib in the raised holding configuration, so that the crane can in particular be weathervaned (that is to say free in rotation to be automatically oriented in the wind direction).

Advantageously, the locking device further comprises:

- a first sensor detecting the presence of the spacer in the release position;
- a second sensor detecting the presence of the spacer in the locking position;
- a third sensor detecting the presence of the abutment bearing on the cylinder body.

Such sensors will allow to drive automatically the aforementioned locking sequence, thus allowing the accurate positioning of the jib in the raised holding configuration and also guarding against unintended movements which may arise during or as a result of the locking sequence which could lead to unintended consequences for the jib, the spacer and the lifting cylinder.

Within the meaning of the invention, the third sensor detects that the abutment is bearing on the cylinder body with a tolerance in the range of 0.5 to 5 centimeters. In other words, the third sensor can detect that the abutment is actually bearing on the cylinder body (in this case the tolerance is zero), or that the abutment is at a given distance (equivalent to the aforementioned tolerance) from the cylinder body. Indeed, and as described later, this third sensor can be used to automatically stop a retraction of the movable rod, such that this tolerance will allow to take into account the latency between the detection made by the third sensor and the actual stop of the movable rod in its retracting movement. This tolerance will depend in particular on the speed of retraction of the movable rod during the locking phase described later.

According to one feature, the first sensor is associated with a first target, wherein one of the first sensor and of the first target is fixed on the jib and wherein the other of the first sensor and of the first target is fixed on the spacer, such that:

- in the presence of the spacer in the release position, the first sensor detects the first target; and
- in the absence of the spacer in the release position, the first sensor does not detect the first target.

This first sensor and this first target thus allow detecting:

- when the spacer is in the release position, which automatically allows leaving the movable rod free to be displaced in the cylinder body in order to act on the displacement of the luffing jib, in particular at high speed; and
- when the spacer is no longer in the release position, which allows automatically stopping the movable rod during the locking sequence until the spacer reaches its locking position.

According to one variant, the first sensor is a proximity sensor or presence sensor, such as for example an optical sensor, a contactor-type mechanical sensor, a capacitive proximity sensor, an inductive proximity sensor, a Hall-effect proximity sensor or an infrared proximity sensor.

According to another feature, the second sensor is fixed on the spacer or on the abutment by being turned in the direction of the movable rod, such that:

- in the presence of the spacer in the locking position, the second sensor detects the movable rod; and
- in the absence of the spacer in the locking position, the second sensor does not detect the movable rod.

This second sensor can be associated with a second target placed on the movable rod, and this second sensor allows detecting when the spacer is in the locking position, which automatically allows retracting the movable rod towards the deployed holding position, in particular at a reduced speed.

According to one variant, the second sensor is a proximity sensor or presence sensor, such as for example an optical sensor, a contactor-type mechanical sensor, a capacitive proximity sensor, an inductive proximity sensor, a Hall-effect proximity sensor or an infrared proximity sensor.

According to another feature, the third sensor is associated with a third target, wherein one of the third sensor and of the third target is fixed on the cylinder body, and the other of the third sensor and of the third target is cantilever-mounted on the abutment in order to extend beyond the abutment, such that:

- in the presence of the abutment bearing on the cylinder body, the third sensor detects the third target; and
- in the absence of the abutment bearing on the cylinder body, the third sensor does not detect the third target.

This third sensor and this third target thus allow detecting when the abutment is bearing on the cylinder body, and therefore when the movable rod is in its deployed holding position, which allows automatically stopping the movable rod and indicating that the locking sequence is complete.

According to one variant, the third sensor is a proximity sensor or presence sensor, such as for example an optical sensor, a contactor-type mechanical sensor, a capacitive proximity sensor, an inductive proximity sensor, a Hall-effect proximity sensor or an infrared proximity sensor.

According to another variant, the other of the third sensor and of the third target is mounted on a support which is secured to the abutment while exceeding from the abutment in a longitudinal direction of the spacer extending from the proximal portion to the distal portion. In other words, the support extends beyond the abutment surface(s) offered by the abutment, this or these abutment surface(s) abutting against the cylinder body at the end of the locking sequence.

In a particular embodiment, the abutment is selectively position-adjustable on the spacer in a longitudinal direction extending from the proximal portion to the distal portion, with the abutment slidably mounted on the distal portion of the spacer and cooperating with at least one locking member adapted to fixedly lock the abutment on the distal portion in several adjustment positions.

Thus, with a same spacer and a same position-adjustable abutment, it is possible to adapt the position of the abutment depending on the length of the jib, which allows to ensure a fixed reach of the jib on the ground regardless of the length of the jib.

Indeed, having a fixed reach of the jib on the ground imposes different jib angles depending on the length of the jib. Thanks to the adjustment of the position of the abutment on the spacer, it is possible to adjust the length of the movable rod in the deployed holding position and consequently adjust the angle of the jib.

In a particular embodiment, one of the abutment and of the distal portion of the spacer is provided with at least a first orifice and the other of the abutment and of the distal portion of the spacer is provided with at least a series of several second orifices, and the locking member is a finger adapted to engage both in a first orifice and in a second orifice selected from the different second orifices providing several adjustment positions.

According to one possibility of the invention, the movable rod is pivotally mounted on the jib along a main pivot axis and the proximal portion of the spacer is pivotally mounted on the jib along this same main pivot axis.

According to another possibility of the invention, the spacer comprises two longitudinal and parallel beams that respectively have proximal ends hinged on the jib and distal ends between which the abutment extends.

In accordance with another advantageous feature of the invention, the abutment has an arcuate shape adapted to partially surround the movable rod in the locking position of the spacer.

The present invention also concerns the feature according to which the locking device further comprises an actuator coupled to the spacer for driving its displacement between the locking position and the release position.

In a particular embodiment, the actuator comprises a locking winch equipped with a drum on which is wound a locking cable that passes over at least one pulley disposed on the jib up to the spacer.

Thus, the winding of the locking cable on the drum allows to raise the spacer from the locking position to the release position, and the disengagement of the drum allows the unwinding of the locking cable authorizing the spacer to lower under its own weight from the release position to the locking position.

Other types of actuator may be envisaged, such as for example and without limitation, a linear cylinder, a rotary motor coupled to the spacer with a cable, belt, chain, connecting rod, etc. It can also be envisaged to provide a motorized actuator or a manual actuator.

According to one possibility, as the end of the locking phase, the jib is locked in the raised holding configuration and is substantially prohibited from moving both in the direction of a lowering by means of the locking device interposed between the abutment body and the jib, and in the direction of a raising by means of the lifting cylinder that holds the jib.

According to another possibility, the crane is a luffing jib tower crane.

The invention also relates to a method for locking a luffing jib in a raised holding configuration, this method being implemented in a crane in accordance with the invention by implementing the following locking sequence:

- in a first phase or operating phase, the spacer is in the release position and the movable rod is free to be displaced in the cylinder body to act on the displacement of the luffing jib;
- in a second phase or transitional phase, the movable rod is deployed to a deployed transition position, beyond the deployed holding position, and the spacer is displaced to its locking position by being folded over the movable rod;
- in a third phase or locking phase, the movable rod is retracted from the deployed transition position towards the deployed holding position until the abutment bears on the cylinder body so that the spacer fixedly maintains the movable rod in the deployed holding position in order to lock the luffing jib in the raised holding configuration.

In a particular embodiment:

- when the spacer is in the release position, the movable rod is free to be displaced in the cylinder body up to a predefined maximum speed;
- when the spacer is in the locking position and the movable rod is in its deployed transition position, the movable rod is retracted towards the deployed holding position at a reduced speed lower than the maximum speed.

According to one variant, the spacer is detected in the release position by means of the first sensor described above.

According to another variant, the spacer is detected in the locking position by means of the second sensor described above.

In a particular embodiment,

- when the spacer has left its release position and has not yet reached its locking position, the movable rod is automatically and substantially prohibited in displacement;
- when the spacer has reached its locking position, the movable rod is again and automatically free in displacement; and
- when the abutment bears on the cylinder body, the movable rod is automatically stopped in its retraction.

According to one variant, it is the first sensor that detects that the spacer has left its release position and it is the second sensor that detects that the spacer has not yet reached its locking position and, afterwards, that the spacer has reached its locking position.

According to another variant, it is the third sensor that detects that the abutment is bearing on the cylinder body and that allows to automatically trigger the stop of the movable rod in its retracting movement during the locking phase.

In a particular embodiment, once the locking device has locked the luffing jib in the raised holding configuration, a step of weathervaning the jib is provided, which includes a disengagement of the jib so that it is free in rotation to be automatically oriented in the direction of the wind.

According to one variant, it is the third sensor that detects that the locking device has locked the luffing jib in the raised holding configuration.

Advantageously, once the locking device has locked the luffing jib in the raised holding configuration, a step of actuating an alarm signaling an authorization of weathervaning the jib is provided prior to the step of weathervaning the jib.

According to one variant, the step of actuating the alarm is automatically triggered as soon as the third sensor detects that the locking device has locked the luffing jib in the raised holding configuration.

The invention also relates to the aforementioned method in which:

- in the operating phase, a first sensor detects the spacer in the release position, automatically authorizing the movable rod to be displaced in the cylinder body up to a predefined maximum speed;
- in the transitional phase, the first sensor detects when the spacer has left its release position, automatically prohibiting the movable rod in displacement;
- in the transitional phase, a second sensor detects when the spacer has reached its locking position, authorizing again and automatically the movable rod to be free in displacement, possibly at a reduced speed;
- in the locking phase, a third sensor detects when the abutment bears on the cylinder body, automatically stopping the movable rod in its retraction and, optionally, automatically triggering the actuation of an alarm signaling an authorization of weathervaning the jib.

BRIEF DESCRIPTION OF THE DRAWINGS

Other features and advantages of the present invention will appear upon the reading of the detailed description below, of an example of a non-limiting implementation, made with reference to the appended figures in which.

DESCRIPTION

Figures 1, 2:
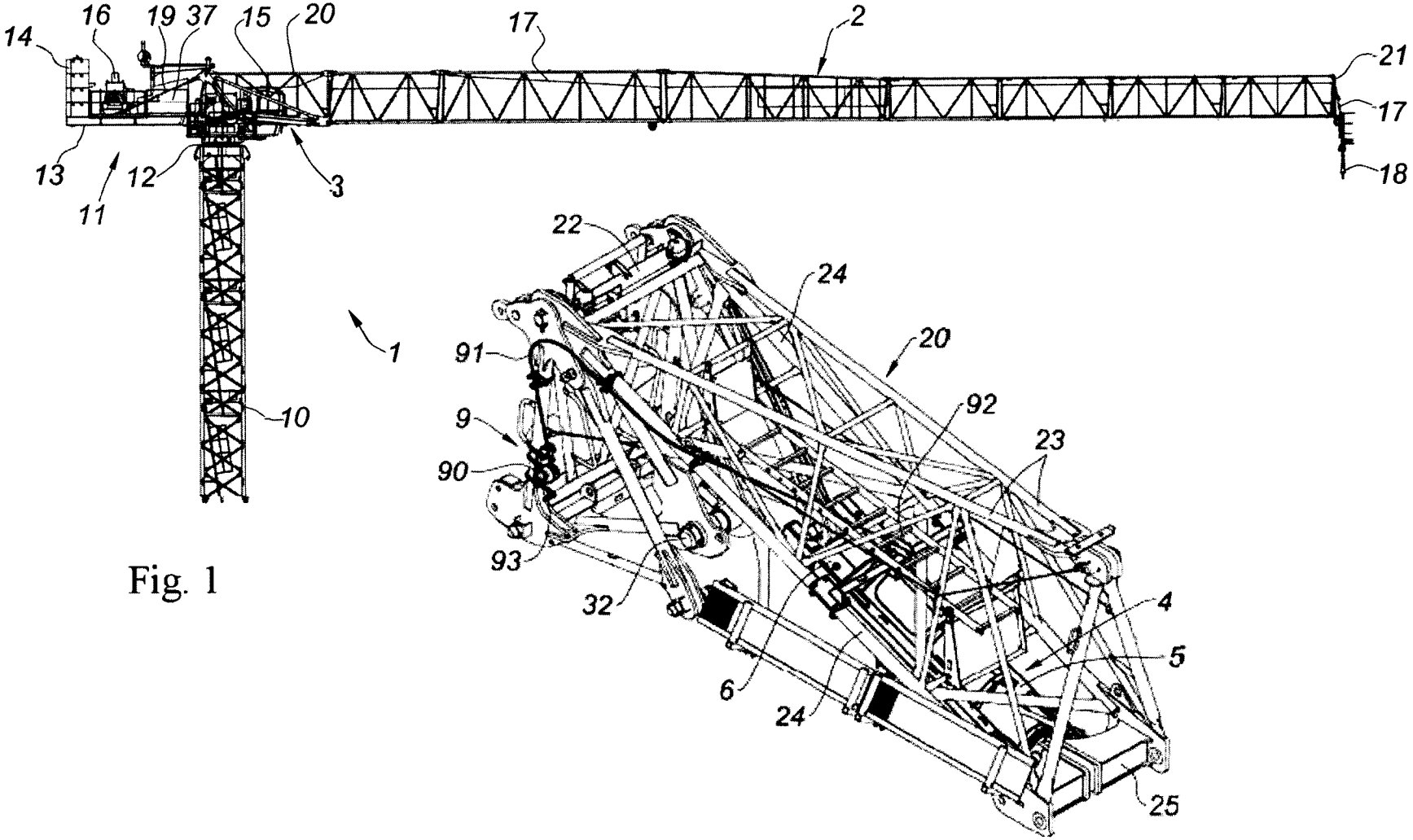
FIG. 1 is a schematic side and partial view of a luffing jib crane in accordance with an embodiment, wherein the locking device is omitted for clarity.
FIG. 2 is a schematic perspective top view of a proximal segment of the jib of the crane of FIG. 1, wherein the locking device is shown.

The luffing jib crane 1, shown in FIG. 1, is here a tower crane that comprises a vertical mast 10 anchored or movable on the ground and surmounted, via an orientation device, by a rotating portion 11 mainly comprising a rotating pivot 12, a counter-jib 13 on which is mounted a counterweight 14, and a luffing jib 2.

The rotating pivot 12 is orientable about the vertical axis of the mast 10 and supports a driver's cab 15 of the crane 1.

The counter-jib 13 extends substantially horizontally rearwards, from the rotating pivot 12, and it carries in particular a hoisting winch 16 for hoisting the loads suspended on the jib 2, as well as the counterweight 14. This counter-jib 13 is suspended by means of tie rods 19.

The hoisting winch 16 has a drum on which is wound a hoisting cable 17 that passes over pulleys, then is directed towards the tip 21 of the jib 2 and extends up to a hoisting hook 18, with or without reeving, the loads to be hoisted being suspended from the hook 18 when using the crane 1.

The luffing jib 2 is formed by a lattice structure, for example of triangular section, and has a hinged proximal segment 20, about a horizontal pivot axis 22, on the rotating pivot 12. This proximal segment 20 forms the foot of the jib 2.

The proximal segment 20 has upper beams 23 and lower beams 24 connected to each other by chords and a lower cross-member 25 located at the end (that is to say opposite to the pivot axis 22) and in the bottom portion of the proximal segment 20. In the lowered configuration of the jib 2 shown in FIGS. 1 and 3, when the jib 2 is horizontal, the upper beams 23 extend substantially horizontally, while the lower beams 24 extend obliquely relative to the horizontal.

Figure 3:
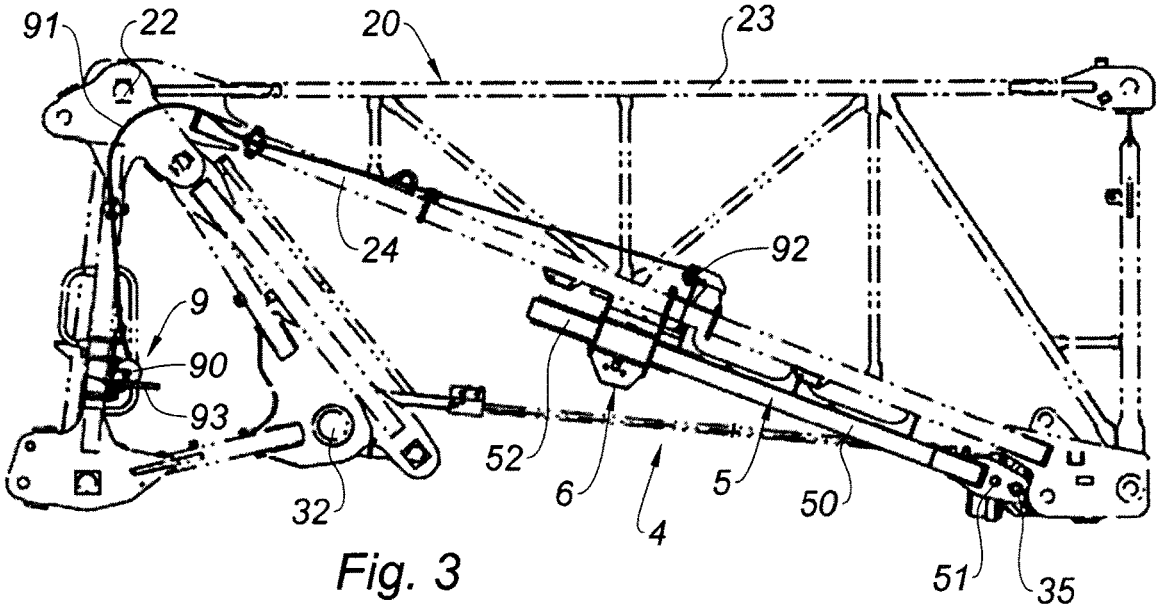
FIG. 3 is a schematic side view of the proximal segment of the jib illustrated in FIG. 2.

The crane 1 further comprises a lifting cylinder 3 that can be of the linear hydraulic cylinder or linear electric cylinder type. This lifting cylinder 3 can act on the proximal segment 20 of the jib 2 to displace the jib 2 between at least one lowered position (as shown in FIGS. 1 and 3) and at least one raised position (as shown in FIGS. 4 to 7). The lifting cylinder 3 comprises a cylinder body 30 and a movable rod 31.

The cylinder body 30 is mechanically connected to the rotating pivot 12 by a pivot connection about a horizontal pivot axis 32. As such, the cylinder body 30 has:

- a rear end 33 supporting a hinge, such as a ball-joint, that mechanically connects the cylinder body 30 to the rotating pivot 12; and
- an open front end 34 and through which opens the movable rod 31, wherein this front end 34 defines an annular bearing surface 340 which is orthogonal to the movable rod 31.

The cylinder body 30 may comprise, at this front end 34, a bearing device that defines this bearing surface 340.

The movable rod 31 is mechanically connected to the proximal segment 20 of the jib 2 by a pivot connection about a horizontal main pivot axis 35, such that this proximal segment 20 is movable between the lowered position and the raised position. When the crane 1 is in operation, the lifting cylinder 3 allows raising or lowering the jib 2, via the proximal segment 20. The movable rod 31 has a front end 36 supporting a hinge, such as a ball-joint, that mechanically connects the movable rod 31 to the proximal segment 20.

The lifting cylinder 3 is a linear cylinder configured so that the movable rod 31 is displaceable in the cylinder body 30 between at least one deployed position (as shown in FIGS. 4 to 7) and at least one retracted position (as shown in FIGS. 1 and 3) in order to raise and lower the jib 2 between at least one raised configuration (as shown in FIGS. 4 to 7) and at least one lowered configuration (as shown in FIGS. 1 and 3).

The crane 1 further comprises a supply device 37 that is configured to supply the lifting cylinder 3 with power so as to raise the jib 2. In the case of a hydraulic lifting cylinder 3, the supply device 37 is a hydraulic station configured to supply the lifting cylinder 3 with hydraulic power. When it is supplied with power, the lifting cylinder 3 can raise the jib 2. The supply device 37 is fixed to the counter-jib 13 and is located relatively close to the lifting cylinder 3, opposite to the counterweight 14.

The lifting cylinder 3 extends in a vertical median plane of the jib 2, such that the hinge of the movable rod 31 on the proximal segment 20 of the jib 2 is located in a vertical median plane of the proximal segment 20. More specifically, the movable rod 31 is hinged on the lower cross-member 25, and more precisely at the middle of this lower cross-member 25.

The crane 1 further comprises a locking device 4 adapted to cooperate with the lifting cylinder 3 to mechanically lock the movable rod 31 of the lifting cylinder 3 in a deployed holding position (shown in FIG. 7) and thus block the jib 2 in a raised holding configuration.

Figure 14:
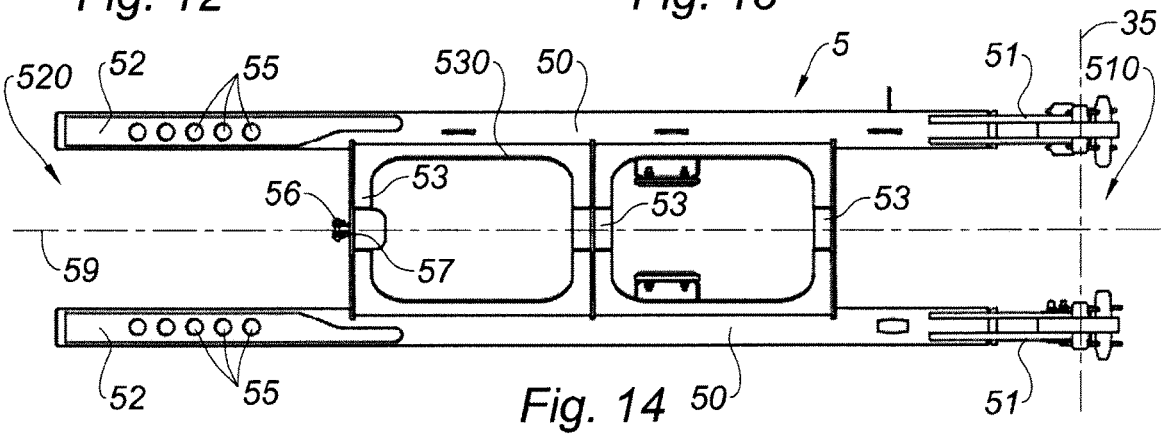
FIGS. 14 and 15 are schematic top views of a spacer, respectively without the abutment and with the abutment, according to an embodiment.
Figure 15:
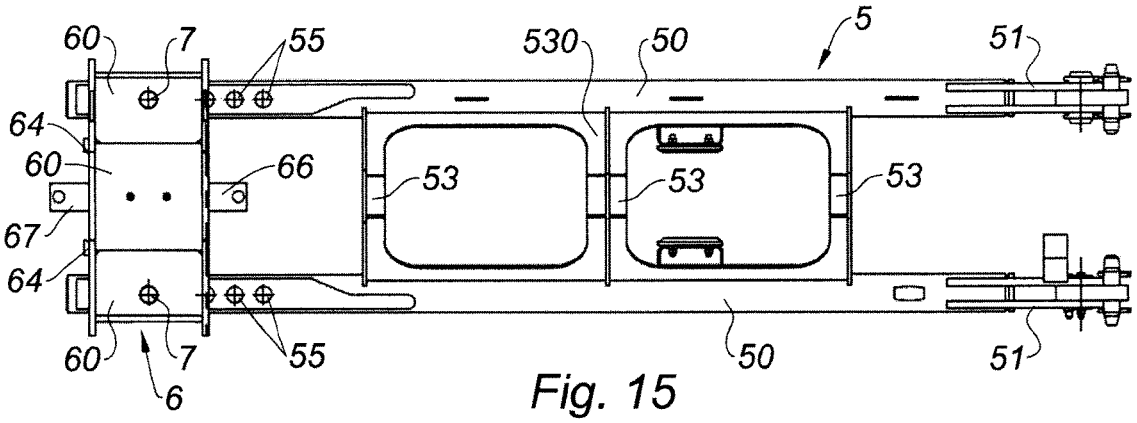

This locking device 4 comprises a spacer 5 (shown alone in FIG. 14) on which is mounted an abutment 6, wherein the spacer 5 is pivotally movable on the proximal segment 20 of the jib 2 between:

- a release position (shown in FIGS. 2 to 4 and 6) wherein the spacer 5 is offset vis-a-vis the lifting cylinder 3 by being folded in the direction of the proximal segment 20; and
- a locking position (shown in FIGS. 5 to 7) wherein the spacer 5 is folded over the lifting cylinder 3, and more precisely on the movable rod 31.

Starting from the release position towards the locking position, the abutment 6 follows an arc of a circle which moves it closer to the movable rod 31 until bearing on the movable rod 31. Conversely, starting from the locking position towards the release position, the abutment 6 follows an arc of a circle that moves it away from the movable rod 31 and moves it closer to the proximal segment 20 of the jib 2.

The spacer 5 comprises two longitudinal beams 50 which are parallel and which respectively have:

- proximal ends 51 hinged on the proximal segment 20 of the jib 2; and
- distal ends 52 between which the abutment 6 extends.

Thus, the spacer 5 comprises a proximal portion 510 composed of the proximal ends 51 of the two longitudinal beams 50, wherein this proximal portion 510 is mechanically connected to the proximal segment 20 of the jib 2 by a pivot connection about the main pivot axis 35 which, as a reminder, corresponds to pivot axis of the movable rod 31 on the proximal segment 20 of the jib 2. In other words, the pivot axis of the spacer 5 on the proximal segment 20 and the pivot axis of the movable rod 31 on the proximal segment 20 are coincident.

Furthermore, the spacer 5 comprises a distal portion 520 composed of the distal ends 52 of the two longitudinal beams 50, wherein this distal portion 520 supports the abutment 6.

The two longitudinal beams 50 have a sufficient spacing to be able to extend on either side of the movable rod 31 in the locking position.

In the release position, the two longitudinal beams 50 extend obliquely relative to the movable rod 31, and extend in particular parallel to the lower beams 24 of the proximal segment 20 of the jib 2.

In the locking position, the two longitudinal beams 50 extend parallel to the movable rod 31.

The spacer 5 also comprises cross-members 53 of an arcuate shape, or more precisely of an arch shape, in a way that the cross-members 53 can match the movable rod 31. These cross-members 53 are positioned in the central portion of the longitudinal beams 50 and connect the two longitudinal beams 50 together. In the illustrated example, the cross-members 53 are secured to a same central part 530 extending fixedly between the two longitudinal beams 50.

The abutment 6 is mounted on the distal ends 52 of the two longitudinal beams 50, by extending transversely between the two longitudinal beams 50. This abutment 5 has an arcuate shape, or more precisely an arch shape, in a way that the abutment 6 can match the movable rod 31.

The abutment comprises:

- two slides 60 slidably mounted on the distal ends 52 of the respective longitudinal beams 50; and
- an arcuate central portion 61 extending between the two slides 60 and defining a groove 63 within which the movable rod 31 is positioned in the locking position;
- two abutment plates 64 fixed on the central portion 61, on either side of the groove 63, wherein these abutment plates 64 are turned in the direction of the annular bearing surface 340 of the front end 34 of the cylinder body 31 in the locking position.

These abutment plates 64 thus define two abutment surfaces adapted to abut against the bearing surface 340, in order to lock the jib 2 in the raised holding configuration.

Each slide 60 is provided with a first orifice 65 passing therethrough, and each longitudinal beam 50 is provided, at its distal end 52, with a series of several second orifices 55 passing therethrough. Thus, the abutment 6 is selectively position-adjustable on the spacer in a longitudinal direction 59 parallel to the longitudinal beams 50, employing locking members in the shape of two locking fingers 7 that engage both in a first orifice 65 and in a second orifice 55 selected from the different second orifices 55 providing several adjustment positions.

Figure 9:
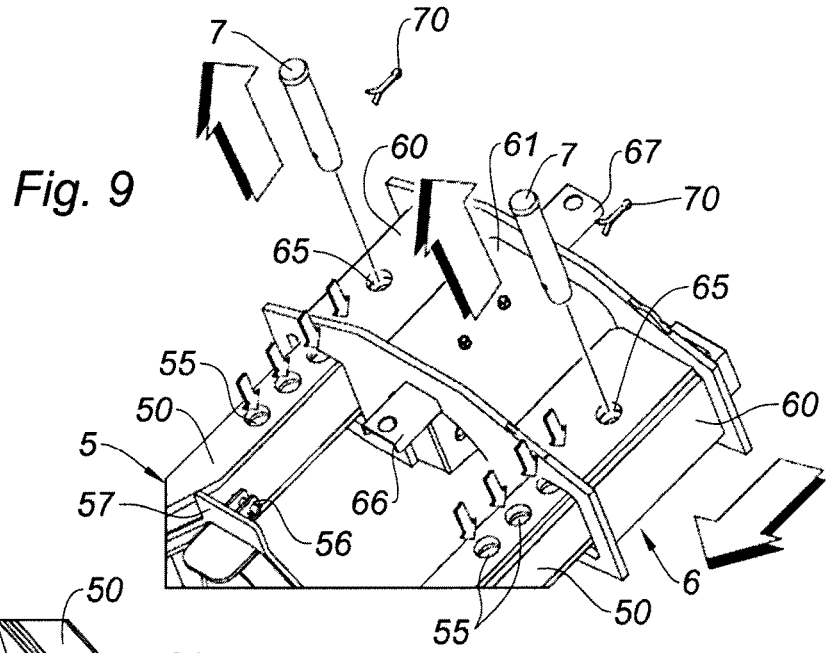
FIG. 9 is a schematic partial and perspective view of the spacer illustrating the means for position-adjusting the sliding abutment according to an embodiment.
Figure 10:
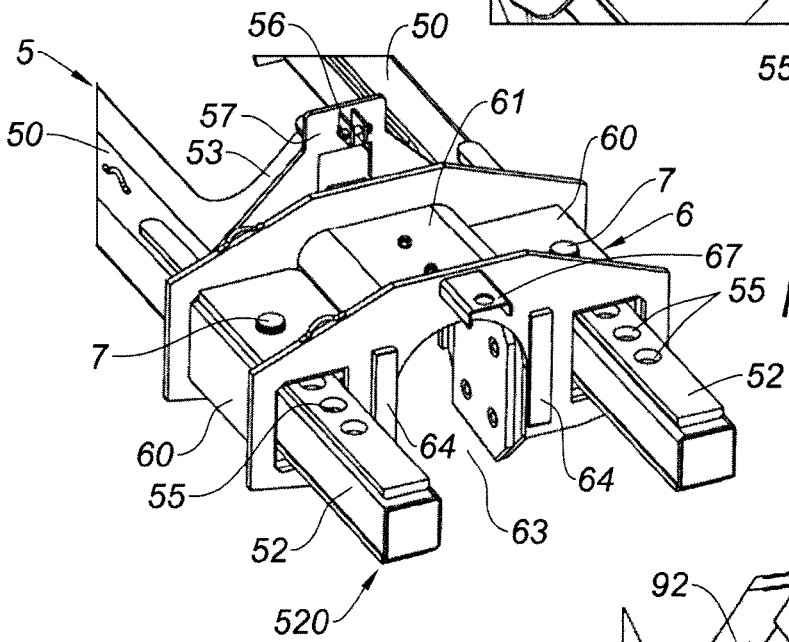
FIG. 10 is a schematic partial and perspective view of the spacer and its abutment, showing the abutment plates of the abutment according to an embodiment.
Figure 11:
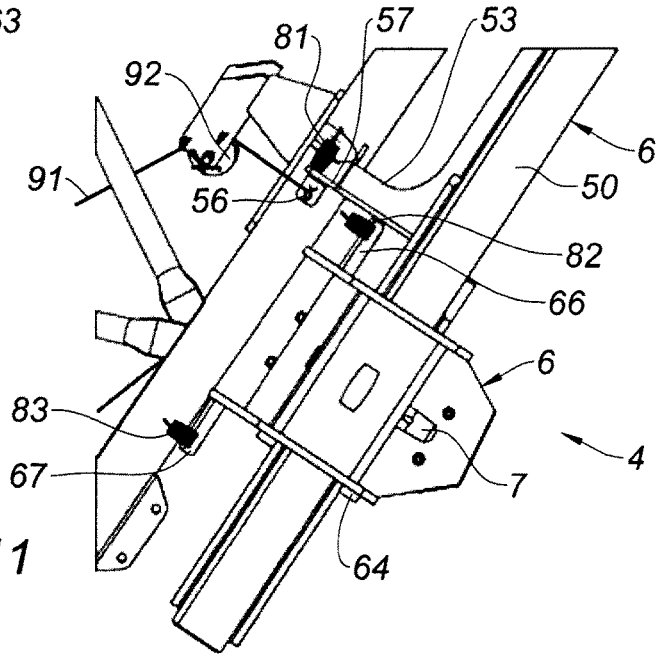
FIG. 11 is a schematic partial and side view of the spacer in a release position according to an embodiment.

Each locking finger 7 can be blocked by means of blocking elements 70, such as for example a nut, a pin (as illustrated in FIG. 9), a sleeve, a circlip, or any other means providing a blocking or a locking of the locking finger 7 on the corresponding slide.

Figure 4:
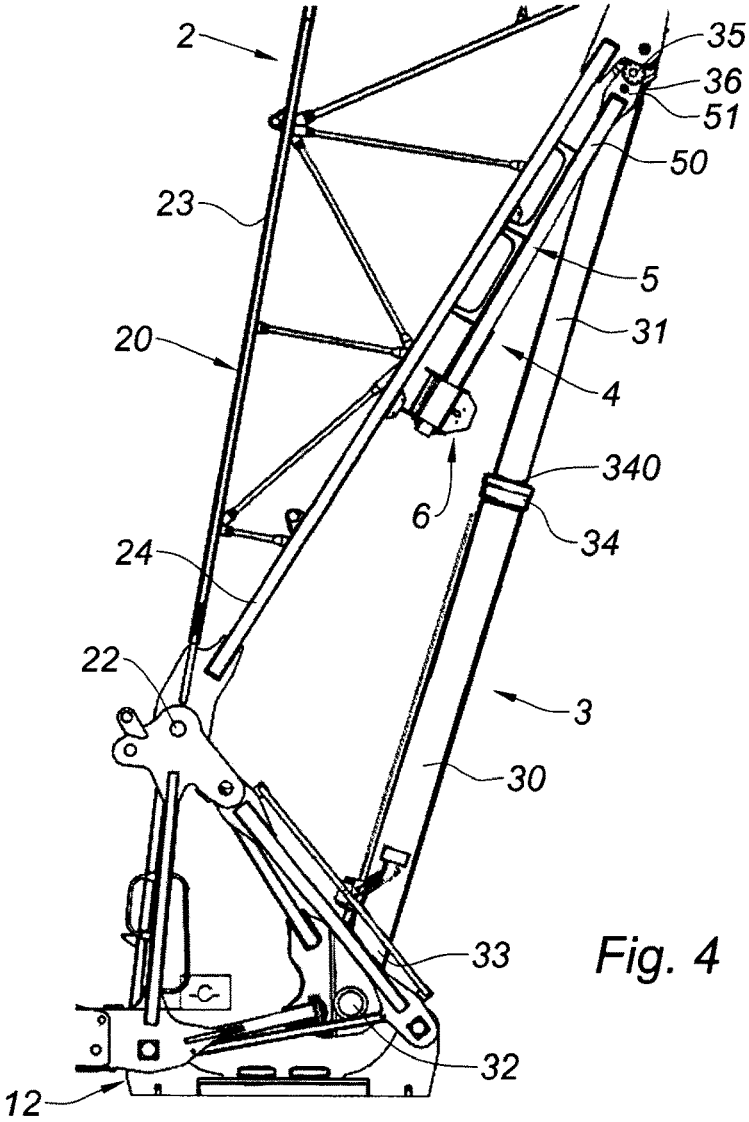
FIG. 4 is a schematic side and partial view of a crane in accordance with an embodiment, wherein the jib is raised in a raised transition configuration with the movable rod of the lifting cylinder in a deployed transition position, and wherein the spacer is in a release position.
Figure 5:
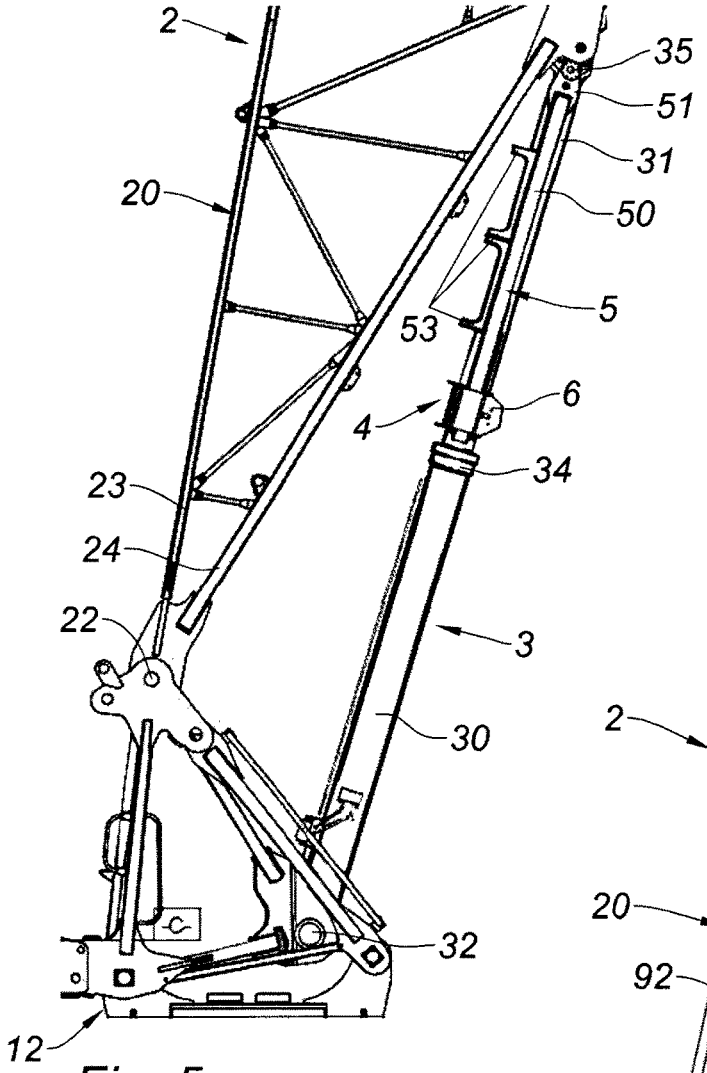
FIG. 5 is a schematic side and partial view of the crane of FIG. 4, wherein the spacer is this time in a locking position.

Thus, according to the positioning of the locking fingers 7 in the second orifices 55, the abutment 6 is more or less close to the proximal portion 510 of the spacer 5 and to the main pivot axis 35. As an illustrative example, the abutment 6 is less close to—or farther from—the proximal ends 51 of the longitudinal beams 50 in the embodiment of FIGS. 4 and 5 compared to the embodiment of FIGS. 6 and 7.

This adjustment of the position of the abutment 6 on the spacer 5 will allow to adjust the length of the movable rod 31 in the deployed holding position (described later) and consequently to adjust the angle of the jib 2 in the raised holding configuration, which allows an adjustment of the reach of the jib 2 on the ground in this raised holding configuration.

The locking device 4 further comprises an actuator that includes a locking winch 9 (shown in FIGS. 2 and 3) equipped with a drum 90 on which is wound a locking cable 91 that passes over pulleys and guides 92 disposed on the proximal segment 20 of the jib 2 up to the spacer 5.

The spacer 5 comprises an anchoring element 56 on which is fixed one end of the locking cable 91. This anchoring element 56 is secured to one of the cross-members 53, and in particular to the cross-member 53 farthest from the proximal ends 51 of the longitudinal beams 50 in order to reduce the force needed to raise the spacer 5.

This locking winch 9 is fixedly mounted on the proximal segment 20 of the jib 2 and the rotation of the drum 90 is performed either manually by means of a crank 93 (as shown in the example of FIGS. 2 and 3) or by means of a motor in a non-illustrated preferred example.

With this locking winch 9, the spacer 5 is displaced as follows:

- from the locking position towards the release position, by rotating the drum 90 in the direction of a winding of the locking cable 91, which allows raising the spacer 5 by pulling it;
- from the release position towards the locking position, by disengaging the drum 90 to release the drum 90 in the direction of an unwinding of the locking cable 91, which allows the spacer 5 to lower under its own weight.

Figure 7:
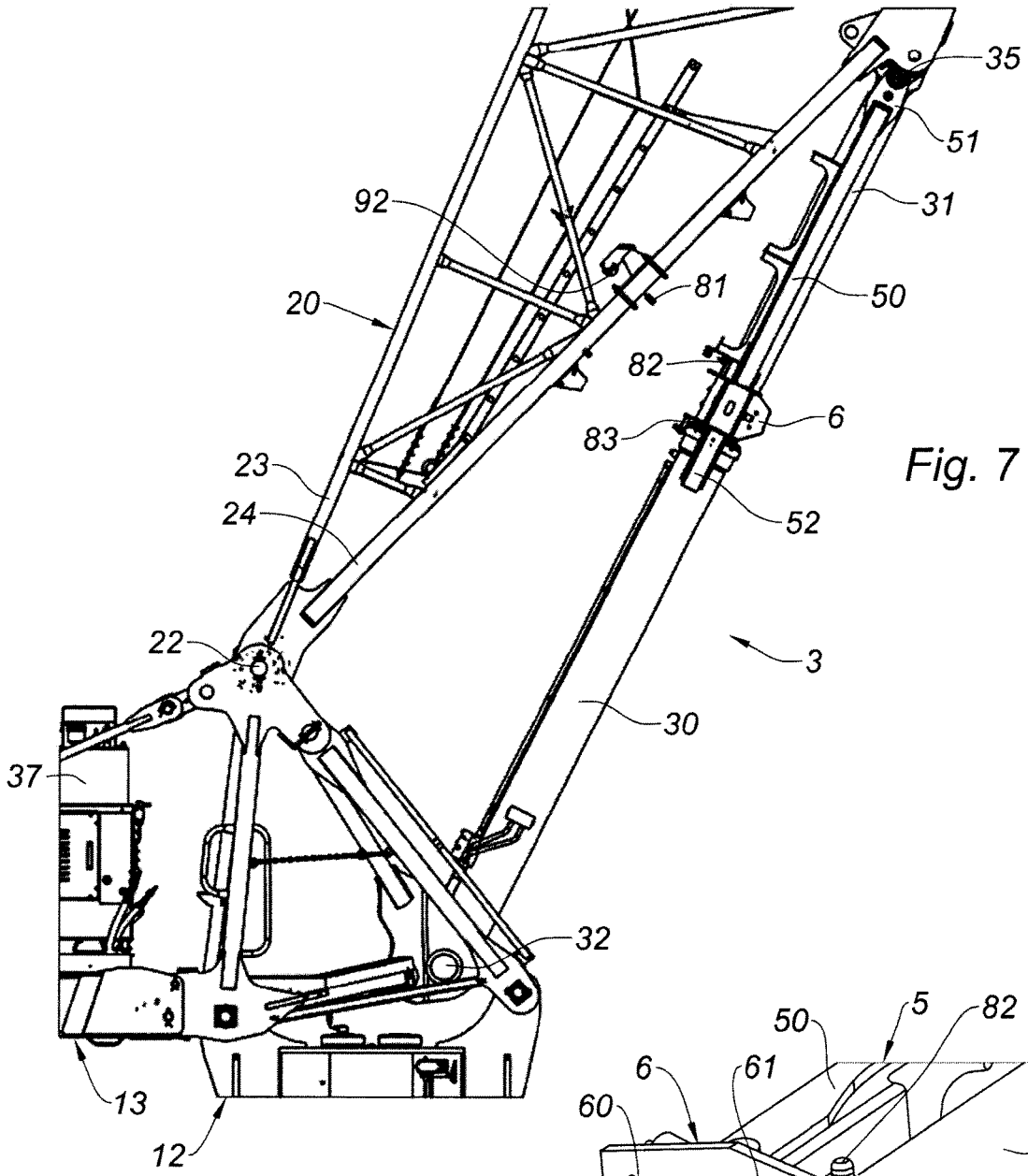
FIG. 7 is a schematic side and partial view of the crane of FIG. 6, wherein the jib is locked in a raised holding configuration with the movable rod of the lifting cylinder blocked in a deployed holding position by means of the spacer (the movable rod having been retracted compared to FIG. 6)

The locking device 4 thus allows the implementation of a locking sequence that results in a locking of the luffing jib 2 in the raised holding configuration (shown in FIG. 7). This locking sequence is performed in three successive phases.

A first phase corresponds to an operating phase wherein the spacer 5 is in the release position (shown in FIGS. 2 to 4, 6 and 11) such that the movable rod 31 is free to be displaced in the cylinder body 30 to act on the displacement of the luffing jib 2, whether lowered or raised. In this operating phase, the movable rod 31 is free to be displaced in the cylinder body 30 up to a predefined maximum speed. Thus, the movable rod 31 can be displaced at the maximum speed authorized. In this operating phase, the crane 1 is in operation and is used for the distribution of loads.

Figure 6:
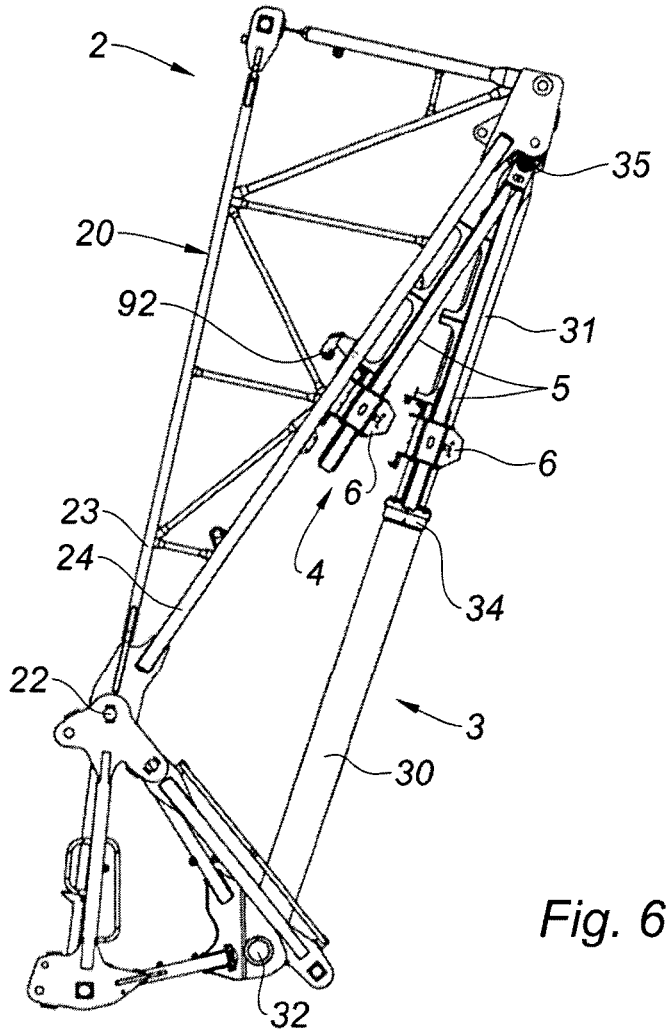
FIG. 6 is a schematic side and partial view of a crane in accordance with an embodiment, wherein the jib is raised in a raised transition configuration with the movable rod of the lifting cylinder in a deployed transition position, and wherein the spacer is illustrated both in a release position and in a locking position (this crane differing from that of FIGS. 4 and 5 in the adjustment of the position of the abutment on the spacer)

A second phase corresponds to a transitional phase wherein, starting from the operating phase, the movable rod 31 is deployed to a deployed transition position (shown in FIGS. 4 to 6). This deployed transition position is located beyond the deployed holding position (described below) and is located close to a maximum deployed position, or even corresponds to a maximum deployed position (that is to say with the movable rod 31 at its maximum length emerging from the cylinder body 30). At the end of this deployment of the movable rod 31 in the deployed transition position, the jib 2 is raised to a raised transition configuration, which is more raised than the deployed holding position.

In this transitional phase, and following the deployment of the movable rod 31 in the deployed transition position, the spacer 5 is displaced from its release position to its locking position (shown in FIGS. 5, 6 and 12) by being folded over the movable rod 31.

Figure 8:
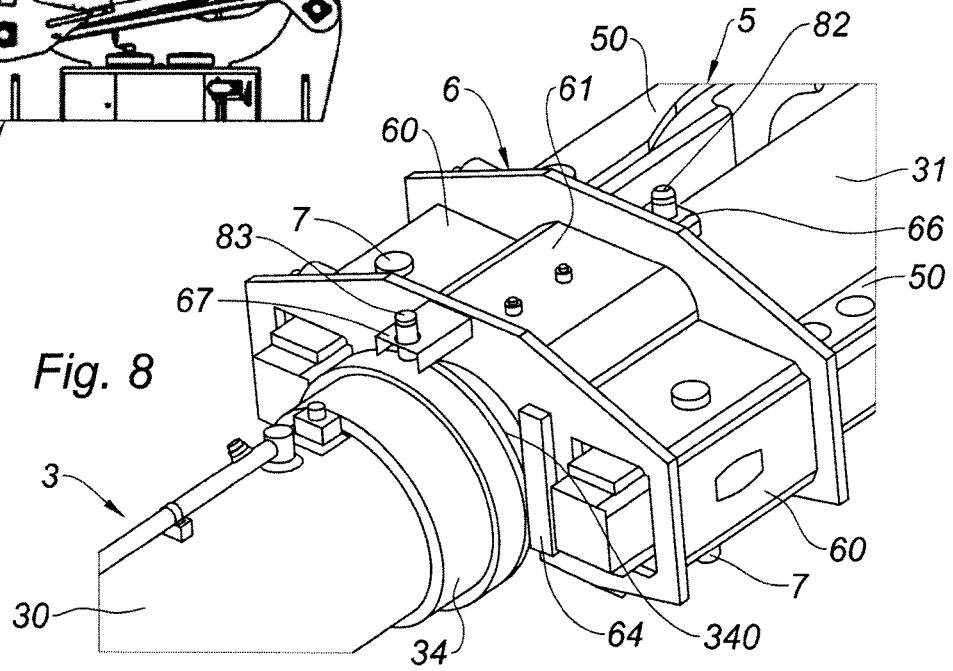
FIG. 8 is a schematic partial and perspective view of the spacer in the locking position, with the abutment bearing on the cylinder body of the hoisting cylinder, according to an embodiment.

A third phase corresponds to a locking phase wherein, following the transitional phase, the movable rod 31 is retracted from the deployed transition position (shown in FIGS. 4 to 6 and 12) to the deployed holding position (shown in FIGS. 7, 8 and 13) until the abutment 6 bears on the cylinder body 30 so that the spacer 5 fixedly maintains the movable rod 31 in the deployed holding position, which results in locking the jib 2 in the raised holding configuration.

In this locking phase, the movable rod 31 is retracted towards the deployed holding position at a reduced speed smaller than the maximum speed, and is then stopped in its retracting movement.

As a result of the locking phase, the abutment 6 is therefore bearing on the cylinder body 30 and more precisely the two abutment plates 64 are bearing on the annular bearing surface 340 of the front end 34 of the cylinder body 31.

Once the locking device 6 has locked the jib 2 in the raised holding configuration, in other words as a result of the locking phase, there is provided a step of weathervaning the jib 2 including a disengagement of the jib 2 (by unblocking orientation brakes provided at the rotating pivot 12) so that the jib 2 is free in rotation along a vertical axis to be automatically oriented in the direction of the wind.

Furthermore, as a result of the locking phase, the jib 2 is prohibited from moving in both directions, namely:

In the direction of a lowering by means of the locking device 4 which is interposed between the abutment body 30 (with the bearing of the abutment 6) and the jib 2 (with the spacer 5 hinged on the jib 2), in particular in case of expansion or leakage of oil with a hydraulic lifting cylinder 3; and In the direction of a lifting by means of the lifting cylinder 3 that holds the jib 2 by preventing it from mounting, in particular in case of whirling wind that pushes the jib 2 from below.

This prohibition is advantageous in the case of an absence of activity and human supervision, the crane 1 being indeed able to be maintained in a desired configuration without supervision.

The locking device 4 further comprises three sensors 81, 82, 83 which will allow to reliably, securely and accurately drive the locking sequence described above.

A first sensor 81 is used to detect the presence/absence of the spacer 5 in the release position. This first sensor 81 is fixed on the proximal segment 20 of the jib 2 and is in the form of a proximity sensor (or presence sensor).

This first sensor 81 is associated with a first target 57 secured to the spacer 5. This first target 57 is in the form of a plate protruding from one of the cross-members 53 in a plane orthogonal to the longitudinal direction 59. When the spacer 5 is in the release position, the plate or first target 57 is located directly facing the first sensor 81, at a predefined distance lower than the reach of the first sensor 81, such that:

in the presence of the spacer 5 in the release position, the first sensor 81 detects the first target 57; and In the absence of the spacer 5 in the release position, the first sensor 81 does not detect the first target.

In the illustrated example, this plate 57 has:

a front face on which the anchoring element 56 is fixed, and a rear face provided to face the first sensor 81 when the spacer 5 is in the release position In a non-illustrated variant, the first sensor 81 is fixed on the spacer 5 while the first target is fixed on the proximal segment 20 of the jib 2 (reverse configuration compared to the one illustrated).

A second sensor 82 is used to detect the presence/the absence of the spacer 5 in the locking position. This second sensor 82 is fixed on the abutment 6 and is in the form of a proximity sensor (or presence sensor).

This second sensor 82 is turned in the direction of the movable rod 31, such that:

in the presence of the spacer 5 in the locking position, the second sensor 82 is located directly facing the movable rod 31, at a predefined distance lower than the reach of the second sensor 82, and thus the second sensor 82 detects the movable rod 31; and In the absence of the spacer 5 in the locking position, the second sensor 82 is distant from the movable rod 31 and therefore does not detect the movable rod 31.

This second sensor 82 is fixed on a board 66 protruding from the central portion 61 of the abutment 6, at the rear thereof (that is to say opposite to the abutment plates 64 and to the cylinder body 30). Thus, this second sensor 82 is cantilever-mounted on the abutment 6 in order to extend to the rear of the abutment 6.

In a non-illustrated variant, the second sensor 82 is fixed on the spacer 5, and in particular on one of the cross-members 53.

A third sensor 83 is used to detect the presence of the abutment 6 bearing on the cylinder body 30, possibly with a tolerance to take into account the latency between the detection made by this third sensor 83 and the stop of its retracting movement in the locking phase. This third sensor 83 is fixed on the abutment 6 and is in the form of a proximity sensor (or presence sensor).

This third sensor 83 is fixed on a board 67 protruding from the central portion 61 of the abutment 6, at the front thereof (that is to say on the same side as the abutment plates 64 and therefore facing the cylinder body 30). Thus, this third sensor 83 is cantilever-mounted on the abutment 6 in order to extend at the front of the abutment 6, and even beyond the abutment 6 in the sense that this third sensor 83 extends overhanging beyond the abutment plates 64 in the longitudinal direction 59.

Figure 13:
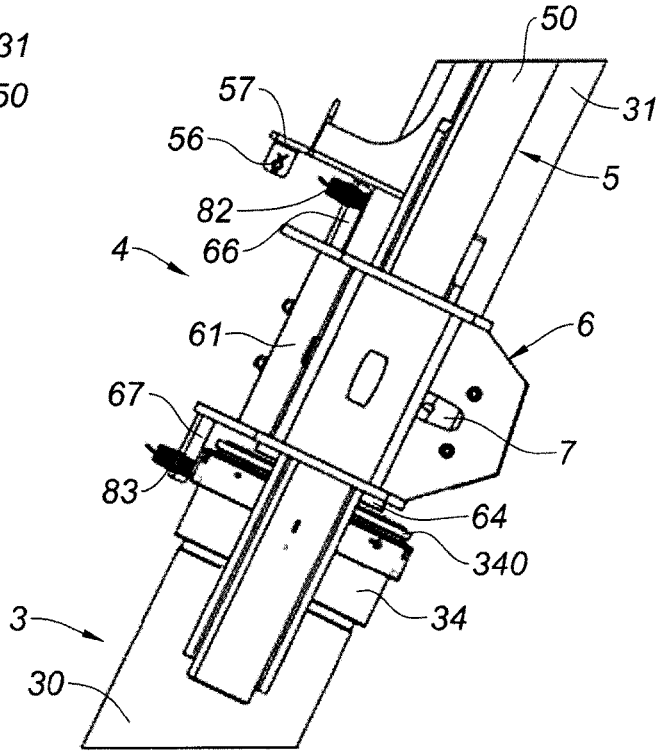
FIG. 13 is a schematic partial and side view of the spacer in a locking position with the mobile rod blocked in a deployed holding position by means of the spacer (the movable rod having been retracted compared to FIG. 12)

This third sensor 83 is turned in the direction of the movable rod 31 and of the cylinder body 30 such that:

In the presence of the abutment 6 bearing on the cylinder body 30 (as shown in FIG. 13), that is to say in the case wherein the abutment 6 is located at a distance lower than or equal to the aforementioned tolerance vis-à-vis the cylinder body 30, the third sensor 83 is directly facing the cylinder body 30 (that forms a third target), at a predefined distance lower than the reach of the third sensor 83, and thus this third sensor 83 detects the cylinder body 30; and In the absence of the abutment 6 bearing on the cylinder body 30, that is to say in the case wherein the abutment 6 is located at a distance greater than the aforementioned tolerance vis-à-vis the cylinder body 30, the third sensor 83 is distant from the cylinder body 30 and therefore does not detect the cylinder body 30.

Figure 12:
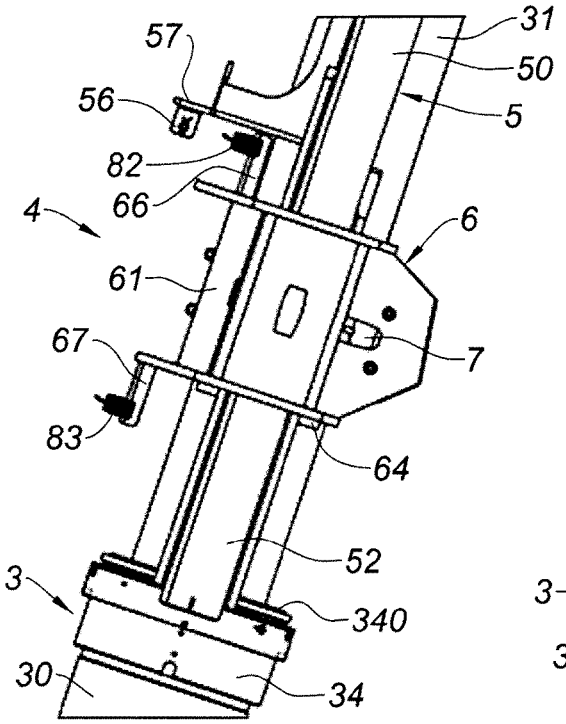
FIG. 12 is a schematic partial and side view of the spacer in a locking position with the movable rod in a deployed transition position according to an embodiment.

In the transitional phase, and as shown in FIG. 12, the third sensor 83 is directly facing the movable rod 31. However, this third sensor 83 is shifted upwards compared to the second sensor 82 such that, in this transitional phase, the second sensor 82 is sufficiently close to the movable rod 31 in order to detect the movable rod 31, while the third sensor 83 is too distant from the movable rod 31 to detect it, in order to avoid false detection by the third sensor 83.

Conversely, in the locking phase, and as shown in FIG. 13, the third sensor 83 is directly facing the cylinder body 30 by being close enough to the cylinder body 30 to detect it.

During the locking sequence described above, these three sensors 81, 82, 83 are used as follows.

The first sensor 81 is used during the operating phase to confirm the presence of the spacer 5 in the release position, and thus authorize the movable rod 31 to move in the cylinder body 30 in order to act on the displacement of the jib 2.

This first sensor 81 is also used during the transitional phase, when the spacer 5 has left its release position and has not yet reached its locking position, to prohibit the displacement of the movable rod 31 and thus automatically maintain it in its deployed transition position. In other words, once the first sensor 81 has detected the absence of the spacer 5 in the release position, and as long as the second sensor 82 has not yet detected the presence of the spacer 5 in the locking position, then the movable rod 31 is fixed in its deployed transition position.

Afterwards, and still in the transitional phase, the second sensor 82 detects the presence of the spacer 5 in the locking position, which allows authorizing the retraction of the movable rod 31 for the locking phase that follows.

Finally, during the locking phase, the third sensor 83 detects that the abutment 6 is bearing on the cylinder body 30, which allows to automatically stop the movable rod 31 in its retraction. This detection by the third sensor 83 can also be used to automatically actuate an alarm (warning light, visual warning, audio warning) indicating the authorization of the weathervaning of the jib 2.

As long as the third sensor 83 detects that the abutment 6 is bearing on the cylinder body 30, the retraction of the movable rod 31 is prohibited, but the deployment of the movable rod 31 is authorized (preferably at a reduced speed) in order to return to the deployed transition position, and afterwards to raise the spacer 5 and get the crane 1 back into an operating phase.

In one embodiment, the crane 1 further includes a controller (not show) having a memory configured to store program instructions and a processor configured to execute the program instructions to control one or more crane operations. The first, second and third sensors 81, 82, 83 may be operably connected to the controller such that the controller is configured to receive information from any of the first, second, and/or third sensors 81, 82, 83 regarding conditions detected by the sensors. The controller may also be operably connected to one or more crane components, such as the as the movable rod 31. For example, in one embodiment, the controller is configured to control operation (e.g., stopping and starting of movement, speed, length of extension, and the like) of the movable rod 31 based on information received from any of the first, second and/or third sensors 81, 82, 83 in the manner described herein.

Of course, the invention is not limited to the sole embodiment of this luffing jib 2 crane 1 that has been described above by way of example and it encompasses, on the contrary, all the variants of construction and application meeting the same principle. Particularly, one would not depart from the scope of the invention:

by modifying or completing the locking winch;

by changing the shape of the spacer and/or of the abutment.

The invention claimed is:

1. A crane comprising:

a luffing jib;

a lifting cylinder comprising a cylinder body mechanically connected to a structural element of the crane and a movable rod hinged on the luffing jib, wherein the movable rod is displaceable in the cylinder body between at least one deployed position and at least one retracted position in order to raise and lower the luffing jib between at least one raised configuration and at least one lowered configuration;

a locking device adapted to cooperate with said lifting cylinder to mechanically lock the movable rod in a deployed holding position and thus block the luffing jib in a raised holding configuration, wherein said locking device comprises a spacer provided with a proximal portion hinged on the jib and with a distal portion supporting an abutment, wherein said spacer is pivotally movable on the jib between:

a release position wherein the spacer is offset vis-à-vis the lifting cylinder such that the distal portion of the spacer is spaced apart from the lifting cylinder, authorizing the movable rod to be displaced in the cylinder body and to act on the displacement of the luffing jib; and a locking position wherein the spacer is folded over the lifting cylinder such that the abutment is able to bear on the cylinder body, wherein a locking of the luffing jib in the raised holding configuration is carried out according to the following locking sequence:

in a first phase or operating phase, the spacer is in the release position and the movable rod is free to be displaced in the cylinder body to act on the displacement of the luffing jib;

in a second phase or transitional phase, the movable rod is deployed to a deployed transition position, beyond the deployed holding position, and the spacer is displaced to the locking position of the spacer by being folded over the movable rod; and in a third phase or locking phase, the movable rod is retracted from the deployed transition position towards the deployed holding position until the abutment bears on the cylinder body so that the spacer fixedly maintains the movable rod in the deployed holding position to lock the luffing jib in the raised holding configuration.

2. The crane according to claim 1, wherein the locking device further comprises:

a first sensor detecting the presence of the spacer in the release position;

a second sensor detecting the presence of the spacer in the locking position; and a third sensor detecting the presence of the abutment bearing on the cylinder body.

3. The crane according to claim 2, wherein the first sensor is associated with a first target, wherein one of the first sensor and of the first target is fixed on the jib and wherein the other of the first sensor and of the first target is fixed on the spacer, such that:

in the presence of the spacer in the release position, the first sensor detects the first target; and in the absence of the spacer in the release position, the first sensor does not detect the first target.

4. The crane according to claim 2, wherein the second sensor is fixed on the spacer or on the abutment being turned in the direction of the movable rod, such that:

in the presence of the spacer in the locking position, the second sensor detects the movable rod; and in the absence of the spacer in the locking position, the second sensor does not detect the movable rod.

5. The crane according to claim 2, wherein the third sensor is associated with a third target, wherein one of the third sensor and of the third target is fixed on the cylinder body, and the other of the third sensor and of the third target is cantilever-mounted on the abutment in order to extend beyond the abutment, such that:

in the presence of the abutment bearing on the cylinder body, the third sensor detects the third target; and in the absence of the abutment bearing on the cylinder body, the third sensor does not detect the third target.

6. The crane according to claim 1, wherein the abutment is selectively position-adjustable on the spacer in a longitudinal direction extending from the proximal portion to the distal portion, with the abutment slidably mounted on the distal portion of the spacer and cooperating with at least one locking member adapted to fixedly lock the abutment on the distal portion in several adjustment positions.

7. The crane according to claim 6, wherein one of the abutment and of the distal portion of the spacer is provided with at least a first orifice and the other of the abutment and of the distal portion of the spacer is provided with at least a series of several second orifices, and the locking member is a locking finger adapted to engage both in a first orifice and in a second orifice selected from the different second orifices providing several adjustment positions.

8. The crane according to claim 1, wherein the movable rod is pivotally mounted on the jib along a main pivot axis and the proximal portion of the spacer is pivotally mounted on the jib along this same main pivot axis.

9. The crane according to claim 1, wherein the spacer comprises two longitudinal and parallel beams that respectively have proximal ends hinged on the jib and distal ends between which the abutment extends.

10. The crane according to claim 1, wherein the abutment has an arcuate shape adapted to partially surround the movable rod in the locking position of the spacer.

11. The crane according to claim 1, wherein the locking device further comprises an actuator coupled to the spacer for driving the displacement of the spacer at least between the locking position and the release position.

12. The crane according to claim 11, wherein the actuator is a locking winch equipped with a drum on which is wound a locking cable that passes over at least one pulley disposed on the jib to the spacer.

13. The crane according to claim 1, wherein, as a result of the locking phase, the jib is locked in the raised holding configuration and is held against movement both in the direction of a lowering by the locking device interposed between the abutment body and the jib, and in the direction of a raising by the lifting cylinder that holds the jib.

14. The crane according to claim 1, wherein the crane is a tower crane.

15. A method for locking a luffing jib in a raised holding configuration, said method comprising:

in a first phase or operating phase, providing a spacer in a release position such that a movable rod that is free to be displaced in a cylinder body to act on a displacement of the luffing jib;

in a second phase or transitional phase, deploying the movable rod to a deployed transition position, beyond a deployed holding position, and displacing the spacer to a locking position of the spacer by being folded over the movable rod;

in a third phase or locking phase, retracting the movable rod from the deployed transition position towards the deployed holding position until an abutment bears on the cylinder body so that the spacer fixedly maintains the movable rod in the deployed holding position in order to lock the luffing jib in a raised holding configuration.

16. The method according to claim 15, wherein:

when the spacer is in the release position, the movable rod is free to be displaced in the cylinder body up to a predefined maximum speed;

when the spacer is in the locking position and the movable rod is in the deployed transition position of the movable rod, the movable rod is retracted towards the deployed holding position at a reduced speed smaller than the maximum speed.

17. The method according to claim 15, wherein:

when the spacer has left the release position of the spacer and has not yet reached the locking position of the spacer, the movable rod is held against displacement;

when the spacer has reached the locking position of the spacer, the movable rod is again free in displacement;

when the abutment bears on the cylinder body, the movable rod is stopped in retraction of the movable rod.

18. The method according to claim 15, wherein, once the spacer and the abutment have locked the luffing jib in the raised holding configuration, there is provided a step of weathervaning the jib comprising disengaging the jib so that the jib is free in rotation to be automatically oriented in the direction of the wind.

19. The method according to claim 18, wherein, once the locking device has locked the luffing jib in the raised holding configuration, there is provided, prior to the step of weathervaning the jib, a step of actuating an alarm signaling an authorization of weathervaning the jib.

20. The method according to claim 15, wherein:

in the operating phase, a first sensor detects the spacer in the release position, for authorizing the movable rod to be displaced in the cylinder body up to a predefined maximum speed;

in the transitional phase, the first sensor detects when the spacer has left the release position of the spacer, for prohibiting movement of the movable rod in displacement;

in the transitional phase, a second sensor detects when the spacer has reached the locking position of the spacer, authorizing again and the movable rod to be free in displacement; and in the locking phase, a third sensor detects when the abutment bears on the cylinder body, for stopping the movable rod in the retraction of the movable rod.

* * * * *